US009064661B2

(12) United States Patent
Westrick, Jr. et al.

(10) Patent No.: US 9,064,661 B2
(45) Date of Patent: Jun. 23, 2015

(54) SYSTEMS AND METHODS FOR DETERMINING ACTUATION DURATION OF A RELAY

(75) Inventors: Richard L. Westrick, Jr., Social Circle, GA (US); Dalibor Zulim, Conyers, GA (US)

(73) Assignee: ABL IP Holding LLC, Conyers, GA (US)

( * ) Notice: Subject to any disclaimer, the term of this patent is extended or adjusted under 35 U.S.C. 154(b) by 211 days.

(21) Appl. No.: 13/533,126

(22) Filed: Jun. 26, 2012

(65) Prior Publication Data

US 2013/0342950 A1 Dec. 26, 2013

(51) Int. Cl.

| | |
|---|---|
| ***H01H 9/00*** | (2006.01) |
| ***H01H 47/00*** | (2006.01) |
| ***H01H 51/22*** | (2006.01) |
| ***H01H 51/30*** | (2006.01) |
| ***H01H 47/22*** | (2006.01) |

(52) U.S. Cl.
CPC ..... *H01H 47/22* (2013.01)

(58) Field of Classification Search
CPC ..... H01H 7/00; H01H 9/56; H01H 47/00; H01H 47/18; H01H 50/86; H01H 2009/566; H01H 2047/008; H01H 2047/009; H01H 2047/025
USPC ..... 361/160, 170
See application file for complete search history.

(56) References Cited

U.S. PATENT DOCUMENTS

| | | | |
|---|---|---|---|
| 4,445,183 | A | 4/1984 | McCollum et al. |
| 4,704,652 | A | 11/1987 | Billings |
| 4,745,511 | A | 5/1988 | Kugelman et al. |
| 4,760,483 | A | 7/1988 | Kugelman et al. |
| 5,055,962 | A | 10/1991 | Peterson et al. |
| 5,267,120 | A | 11/1993 | Graff et al. |
| 5,790,354 | A | 8/1998 | Altiti et al. |
| 5,930,104 | A | 7/1999 | Kadah et al. |

(Continued)

FOREIGN PATENT DOCUMENTS

| | | |
|---|---|---|
| EP | 0997921 | 5/2000 |
| FR | 2346883 | 10/1977 |

OTHER PUBLICATIONS

"Temperature Considerations for DC Relays", Application Note, Tyco Electronics Corporation—P&B, http://relays.te.com/appnotes/app_pdfs/13c3226.pdf, 2 pages.

*Primary Examiner* — Thienvu Tran
*Assistant Examiner* — Christopher Clark
(74) *Attorney, Agent, or Firm* — Kilpatrick Townsend & Stockton, LLP

(57) ABSTRACT

An example system for determining the actuation duration of a relay can include a relay, a current-sensing device, and a controller. The relay can have an actuation coil, and armature, and a first and second contact. The current-sensing device can measure a current through the actuation coil. The controller can actuate the relay. The controller can also receive from the current-sensing device a plurality of measurement values for the current through the actuation coil. The controller can determine an actuation duration based on a local minimum value for the plurality of measurement values. The actuation duration can correspond to a duration of a movement of an armature of the relay from the first contact of the relay to the second contact of the relay. An actuation delay of the relay can be calculated based on the zero-crossing time of an input voltage value and the actuation duration.

15 Claims, 13 Drawing Sheets

(56) References Cited

U.S. PATENT DOCUMENTS

| | | | | |
|---|---|---|---|---|
| 6,226,167 | B1 | 5/2001 | Chmiel | |
| 6,233,132 | B1 * | 5/2001 | Jenski | 361/160 |
| 6,621,270 | B2 | 9/2003 | Johnson et al. | |
| 6,621,668 | B1 | 9/2003 | Sare | |
| 6,643,112 | B1 | 11/2003 | Carton et al. | |
| 6,903,554 | B2 | 6/2005 | Wilson et al. | |
| 7,212,090 | B2 | 5/2007 | Kadah | |
| 7,463,036 | B2 | 12/2008 | Finney et al. | |
| 7,573,360 | B2 | 8/2009 | Bryan et al. | |
| 7,660,083 | B2 | 2/2010 | Yao et al. | |
| 7,746,620 | B2 | 6/2010 | Bedingfield | |
| 7,782,590 | B2 | 8/2010 | Bedingfield et al. | |
| 2003/0218847 | A1 | 11/2003 | Lesesky et al. | |
| 2004/0169987 | A1 | 9/2004 | Green | |
| 2006/0164778 | A1 | 7/2006 | Beletsky et al. | |
| 2007/0108845 | A1 | 5/2007 | Crane | |
| 2008/0013227 | A1 | 1/2008 | Mernyk et al. | |
| 2009/0027824 | A1 | 1/2009 | Allen et al. | |
| 2009/0105415 | A1 | 4/2009 | Liu et al. | |
| 2009/0213519 | A1 | 8/2009 | Bedingfield | |
| 2009/0213520 | A1 | 8/2009 | Bedingfield et al. | |
| 2011/0228438 | A1 * | 9/2011 | Kohri et al. | 361/187 |

* cited by examiner

SYSTEMS AND METHODS FOR DETERMINING ACTUATION DURATION OF A RELAY

FIELD OF THE INVENTION

The present invention is directed to determining the duration for actuating a relay, such as an electromechanical relay.

BACKGROUND

Electrical systems can include devices for switching of electric power, such as a relay. A relay, such as an electromechanical relay, can include one or more contacts for switching power from a power source to a load, such as an electrical device. Detecting the position of a contact of a relay can be used to determine whether the relay is functional. Detecting the position of a contact of a relay can also provide a notification that a relay is in a closed position and that a high voltage is present on the output of the relay.

Detecting the duration of the movement of an armature of a relay from a first contact position, such as an open position preventing current from flowing between a power source and a load, to a second contact position, such as a closed position allowing current to flow between a power source and a load, can also present advantages. The operational lifespan of a relay can be increased by switching power to a load at a point at which a sinusoidal input voltage or current from a power source has a zero value ("a zero crossing"). Such loads can include a purely reactive load (including inductive and capacitive), resistive load, and any combination of the resistive and reactive loads. Setting a relay to a closed position at or near a point in time associated with the zero crossing of the input line voltage can significantly reduce or completely eliminate an inrush current to a reactive load.

The duration involved in actuating a relay from an open position to a closed position can vary significantly between relays. The actuation duration can be the difference between a first point in time at which a relay is actuated and a second point in time at which a contact of a relay is at a closed position. Configuring the timing for actuating a relay can include offsetting a point in time at which a relay is actuated from a point in time associated with a zero crossing.

Previous solutions for detecting the position of a contact in applications involving switching multiple voltages can include complex detection circuitry rated for use with relays switching high voltages, thereby increasing the overall cost of the solution and decreasing the reliability of the product for which the solution is used.

Accordingly, simplified systems and methods for determining the actuation duration are desirable.

SUMMARY

Aspects of the invention provide systems and methods for determining the duration of actuation of a relay, such as an electromechanical relay. An example system can include a relay, a current-sensing device, and a controller. The relay includes an actuation coil, an armature, and at least two contacts. The current-sensing device can be configured to measure a current through the actuation coil. The controller can be configured to actuate the relay. The controller can be further configured to receive from the current-sensing device a plurality of measurement values for the current through the actuation coil. The controller can be further configured to determine an actuation duration based on a local minimum value for the plurality of measurement values. The actuation duration can correspond to a duration of the movement of the armature of the relay from the first contact of the relay to the second contact of the relay.

These and other aspects, features and advantages of the present invention may be more clearly understood and appreciated from a review of the following detailed description and by reference to the appended drawings and claims.

DETAILED DESCRIPTION

Aspects of the present invention determine the duration of actuation of a relay, such as an electromechanical relay. A current through the actuation coil of the relay can be measured to determine whether the relay is open or closed as well as the duration involved in actuating the relay from an open to a closed position. The current through the actuation coil can increase in non-linear manner, followed by a decrease to a local minimum value for the amount of current passing through the actuation coil. The actuation duration of a relay, which can vary from a few microseconds to tens of milliseconds, can be determined from a duration between a time at which an actuation voltage or current is provided to the actuation coil and a time at which a current through the actuation coil decreases to a local minimum value. The actuation duration of the relay can be used to actuate the relay at a point in time that is offset from a point in time corresponding to the zero crossing for an input voltage waveform of the relay. Actuating the relay at a point in time that is offset from a point in time corresponding to the zero crossing can minimize inrush current to a load coupled to the relay, thereby increasing the operational lifespan of the relay. Examples of such loads can include a purely reactive load (inductive or capacitive), a resistive load, and any combination of resistive and reactive loads. Using a current-sensing device such as a resistor can reduce the complexity and increase the reliability of a system for detecting the position of a contact of a relay.

These illustrative examples are given to introduce the general subject matter discussed herein and are not intended to limit the scope of the disclosed concepts. The following sections describe various additional aspects and examples with reference to the drawings in which like numerals indicate like elements.

The features discussed herein are not limited to any particular hardware architecture or configuration. A computing device can include any suitable arrangement of components that provide a result conditioned on one or more inputs. Suitable computing devices include multipurpose microprocessor-based computer systems accessing stored software that programs or configures the computing system from a general-purpose computing apparatus to a specialized computing apparatus implementing one or more aspects of the present subject matter. Any suitable programming, scripting, or other type of language or combinations of languages may be used to implement the teachings contained herein in software to be used in programming or configuring a computing device.

Example Operating Environment

Figure 1:
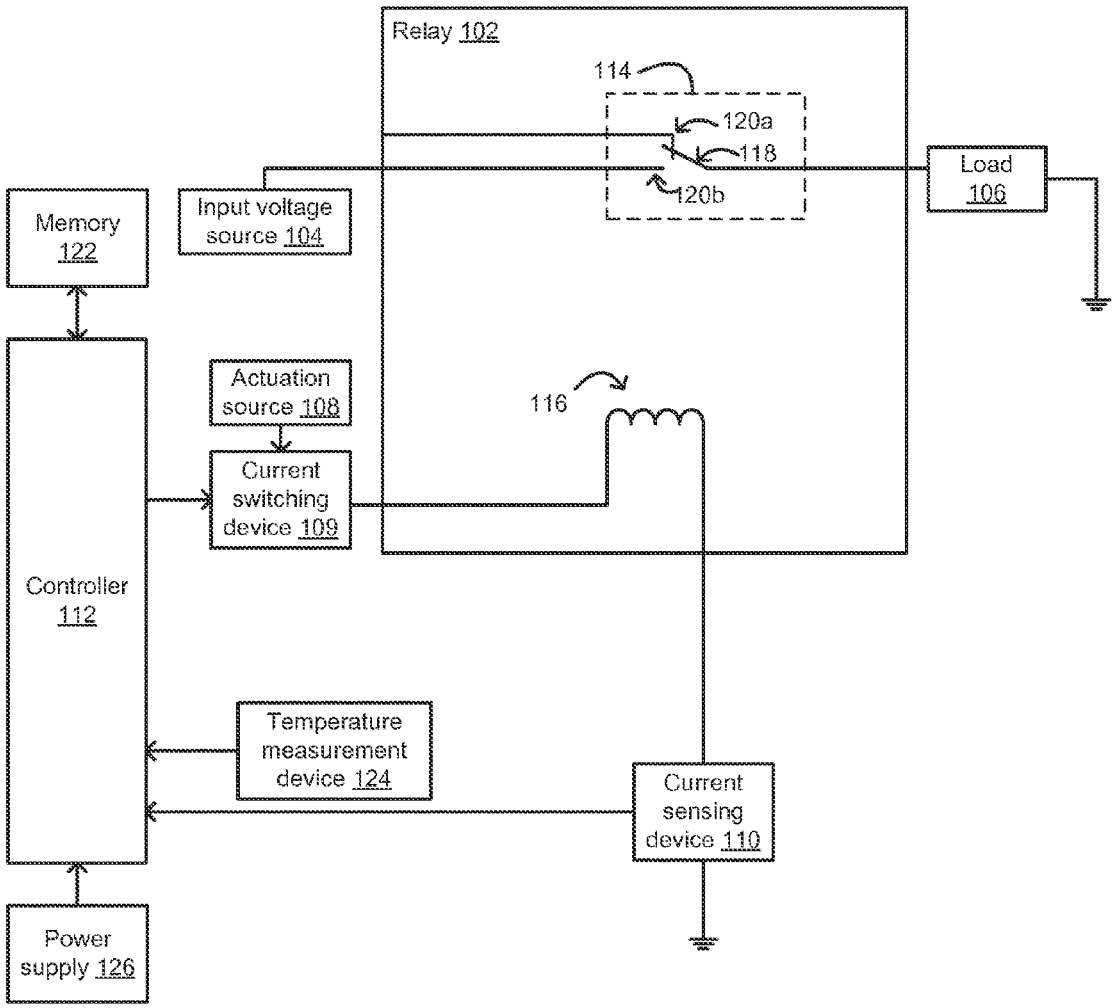
FIG. 1 is a block diagram illustrating an example system for determining the actuation duration of a relay.
Figure 2:
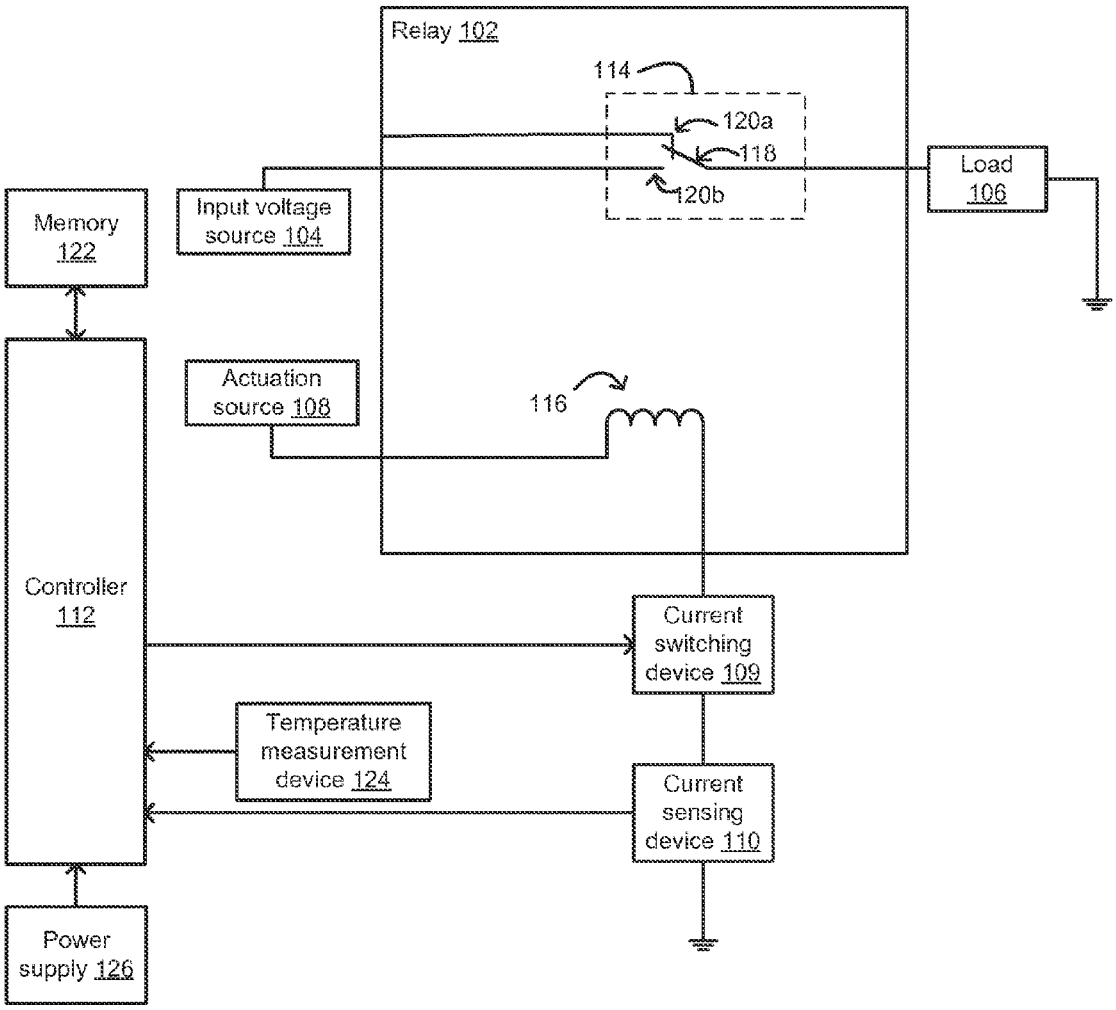
FIG. 2 is a block diagram illustrating an alternative example system for determining the actuation duration of a relay.

FIGS. 1 and 2 illustrate example systems for determining the actuation duration of an example relay 102. Each of the example systems can include a current sensing device 110, a switching device 109, a controller 112, and a temperature measurement device 124. The controller 112 can determine the actuation duration of the relay 102 based on measurement values for an electrical current passing through an actuation coil 116 of the relay 102. A power supply 126 can provide power to the controller 112. A non-limiting example of a power supply 126 is a voltage source providing a voltage of 3.3 V or 5 V.

The relay 102 can be coupled to an input voltage source 104, a load 106, an actuation source 108, and a current sensing device 110. The input voltage source 104 can alternatively include an external voltage source, as depicted in FIG. 1, or a voltage source included in and/or controlled by the controller 112. The relay 102 can selectively couple the input voltage source 104 to the load 106. The relay 102 can have an open position in which the input voltage source 104 is not coupled to the load 106 via the relay 102. The relay 102 can have a closed position in which the input voltage source 104 is coupled to the load 106 via the relay 102. The input voltage source 104 can provide a sinusoidal voltage waveform to the load 106 via the relay 102 in a closed position.

The relay 102 can include a switch 114 and the actuation coil 116. The switch 114 can include an armature 118 and contacts 120*a*, 120*b*. Although FIG. 1 depicts the relay 102 as having two contacts 120*a*, 120*b*, a relay 102 can include any number of contacts. The open position of the relay 102 can include the armature 118 being in contact with the contact 120*a*. The closed position of the relay 102 can include the armature 118 being in contact with the contact 120*b*. The actuation coil 116 can provide a magnetic field causing the armature 118 to move from contact 120*a* to contact 120*b*.

Some aspects of the relay 102 can include a retention mechanism, such as an expansion spring, causing the armature 118 to be retained in an open position in the absence of a magnetic field provide by the actuation coil 116. Other aspects of the relay 102 can include using a pulse, such as a voltage or current pulse, to change the state of the relay. For example, a relay 102 that is a latching relay can be set to an "ON" position by a positive pulse and can be set to an "OFF" position by a negative pulse. Such a latching relay can include a magnet to retain the armature 118 in a respective position.

The relay 102 can be actuated by the actuation source 108. The actuation source 108 can be a source of current or voltage electrically coupled to the actuation coil 116. For example, the actuation source 108 can include a voltage source providing an actuation voltage of 6 V, 12 V, 24 V, etc. The actuation coil 116 can include, for example, a coil of wire helically surrounding an iron core. The actuation source 108 can set the relay 102 to a closed position by providing a voltage or electrical current to the actuation coil 116, thereby causing an electrical current to pass through the actuation coil 116. The electrical current passing through the actuation coil 116 can generate the magnetic field causing the armature 118 to move from contact 120*a* to contact 120*b*. The actuation source 108 can set the relay 102 to an open position by ceasing to provide the voltage or electrical current to the actuation coil 116, thereby causing the magnetic field to cease. In the absence of the magnetic field, the retention mechanism can cause the armature 118 to move from contact 120*b* to contact 120*a*.

The switching device 109 can be used to actuate the flow of electrical current through the actuation coil 116. In some aspects, the current switching device 109 can be disposed such that the current switching device 109 is in series with the actuation source 108 and the actuation coil 116, as depicted in FIG. 1. In other aspects, the current switching device 109 can be disposed such that the current switching device 109 is in series with the actuation coil 116 and the current sensing device 110, as depicted in FIG. 2. Non-limiting examples of the switching device 109 are provided below in FIGS. 7-13.

The switching device 109 can be controlled by the controller 112. In some aspects, the controller 112 can configure the switching device 109 to allow a current pulse to be provided by an actuation source 108 that is a current source to the actuation coil 116. In other aspects, the controller 112 can configure the switching device 109 to allow a voltage pulse to be provided by an actuation source 108 that is a voltage source to the actuation coil 116.

A delay can occur between a time at which the actuation source 108 provides the voltage or electrical current to the actuation coil 116 and a time at which the armature 118 contacts the contact 120*b*. The delay can have a value in a range of a few microseconds to tens of milliseconds. The delay can be the actuation duration of the relay 102.

The controller 112 can determine the actuation duration of the relay 102 by determining a duration of the movement of the armature 118 from the contact 120*a* to the contact 120*b*, i.e., the time associated with the armature moving from contact 120*a* to contact 120*b* once the coil is activated. The controller 112 can execute code stored on a computer-readable medium, such as a memory 122, to determine the actuation duration of the relay 102. Examples of controller 112 include a microprocessor, an application-specific integrated circuit ("ASIC"), a field-programmable gate array ("FPGA"), or other suitable processor. The controller 112 may include one processor or any number of processors. Some aspects can include the controller 112 communicating with one or more of the input voltage source 104, the actuation source 108, the current sensing device 110, a memory 122, and a temperature measurement device 124. The memory 122 may be any non-transitory computer-readable medium capable of tangibly embodying code. Examples of a non-transitory computer-readable medium may include (but are not limited to) an electronic, optical, magnetic, or other storage device capable of providing a processor with computer-readable instructions.

The current sensing device 110 can be used to measure the electrical current passing through the actuation coil 116. The current sensing device 110 can include, for example, a current sense resistor in series with the actuation coil 116.

The relay 102 can also include the temperature measurement device 124. The temperature measurement device 124 can determine a temperature of the actuation coil 116. In some aspects, the temperature measurement device 124 can directly measure the temperature of the actuation coil 116. In other aspects, the temperature measurement device 124 can measure an ambient temperature at a location sufficiently close to the actuation coil 116 so as to provide an accurate determination of the temperature of the actuation coil 116. In some aspects, a temperature measurement device 124 external to the relay 102 can be coupled to a probe disposed within the relay 102. In other aspects, a temperature measurement device 124 can be integrated with the relay 102.

Non-limiting examples of the temperature measurement device 124 can include a thermistor, a diode, a temperature probe, an integrated circuit, etc.

The actuation duration of the relay 102 is depicted in FIG. 2. Graph 202 depicts switching device 109 allowing the actuation source 108 to provide a coil voltage pulse to the actuation coil 116 at a time value 208 at which the relay 102 is at an open position. Graph 204 depicts an electrical current passing through to the actuation coil 116. Graph 206 depicts an ON state of the electrical current passing through load 106 at a time value 216 at which the relay 102 is at a closed position. Graph 207 depicts an electrical current passing through to the actuation coil 116.

The relay 102 being at a closed position, as depicted in the graph 206, can be associated with a load 106 being in an "OFF" state. A load 106 in an "ON" can be associated with a load current waveform that is sinusoidal. A current waveform for a purely resistive load 106 can be sinusoidal. A current waveform for a reactive load 106 can include harmonics.

The graph 204 depicts the electrical current $i_{coil}$ passing through the actuation coil 116 in response to a coil voltage pulse $V_{actuation}$ provided by the actuation source 108. The electrical current $i_{coil}$ passing through the actuation coil 116 can increase in a non-linear manner based on the inductance L of the actuation coil 116. The voltage difference V across the actuation coil 116 can be represented by the equation $$V = L\frac{\partial i_{coil}}{\partial t}.$$

Accordingly, the electrical current $i_{coil}$ passing through the actuation coil 116 can be represented by the equation $$i_{coil} = \int \frac{V}{L}\partial t.$$

The electrical current $i_{coil}$ passing through the actuation coil 116 can increase to a local maximum current value 210 at a time value 212. The electrical current $i_{coil}$ can decrease to a local minimum current value 214 at a time value 216. The decrease in the electrical current $i_{coil}$ can be caused by a second current induced in the actuation coil 116. A magnetic field can be generated by the electrical current passing through the actuation coil 116. The movement of the armature 118 through the magnetic field can generate the second current. The second current can oppose the magnetic field. The second current can oppose the electrical current passing through the actuation coil 116 that is caused by the actuation source 108 providing the voltage coil pulse. The electrical current $i_{coil}$ decreasing to the local minimum current value 214 at the time value 216 can correspond to the armature 118 of the relay 102 contacting the contact 120*b*. The armature 118 can cease movement as a result of the armature 118 contacting the contact 120*b*. Ceasing the movement of the armature 118 can cease the second current opposing the electrical current passing caused by the voltage coil pulse from the actuation source 108. The electrical current $i_{coil}$ can increase after the time value 216. The electrical current $i_{load}$ can pass through the load 106 after the time value 216 at which the relay 102 is set to a closed position.

For a relay 102 that includes a retention mechanism, the armature 118 of the relay 102 can remain in a position contacting the contact 120*b* so long as the electrical current $i_{coil}$ passes through the actuation coil 116. Additionally or alternatively, a relay 102 that is a latching relay may not include the electrical current $i_{coil}$ continuously passing through the actuation coil 116.

Figure 3:
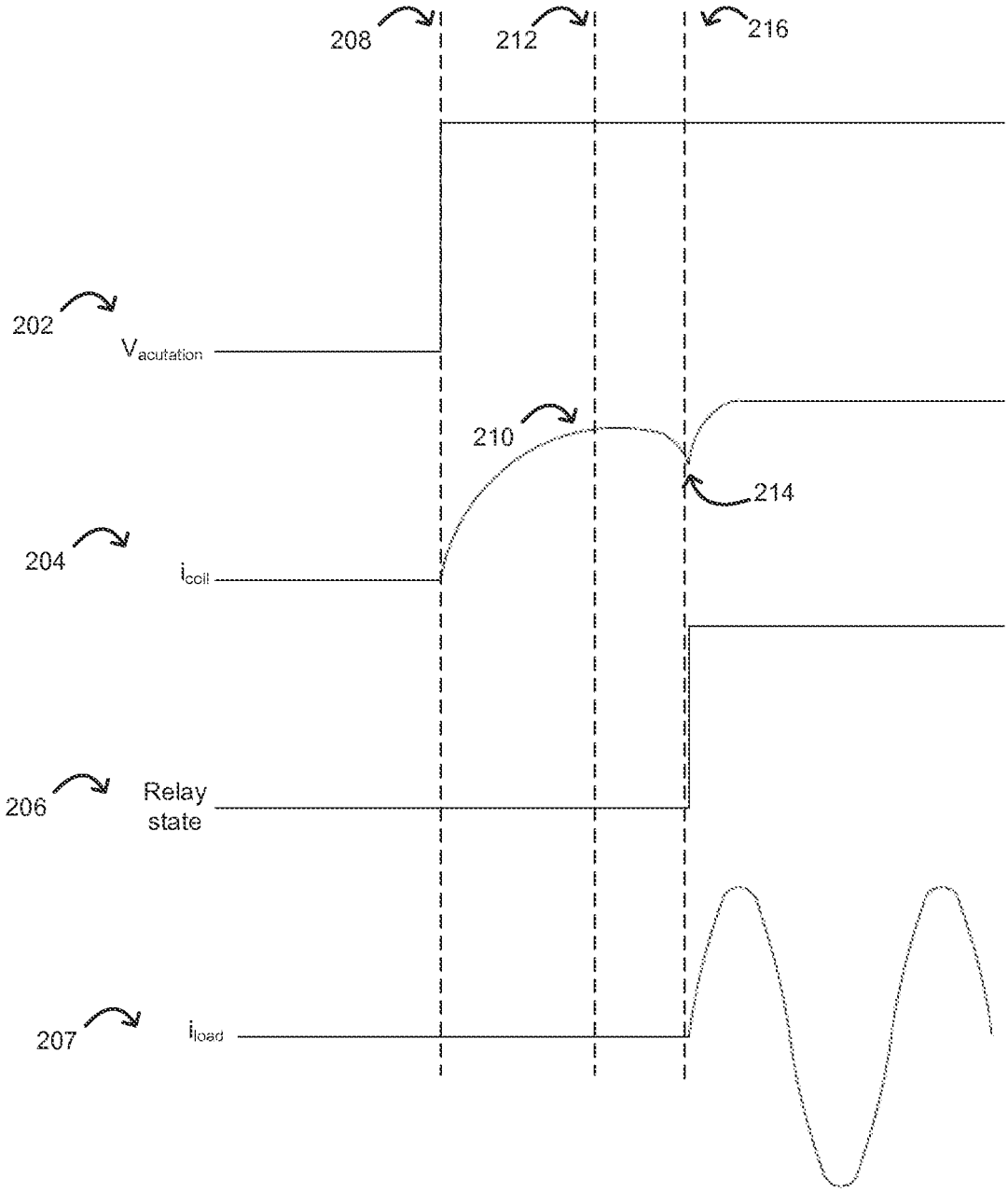
FIG. 3 is a series of graphs illustrating an example relationship between actuation voltage and electrical current through a relay.
Figure 4:
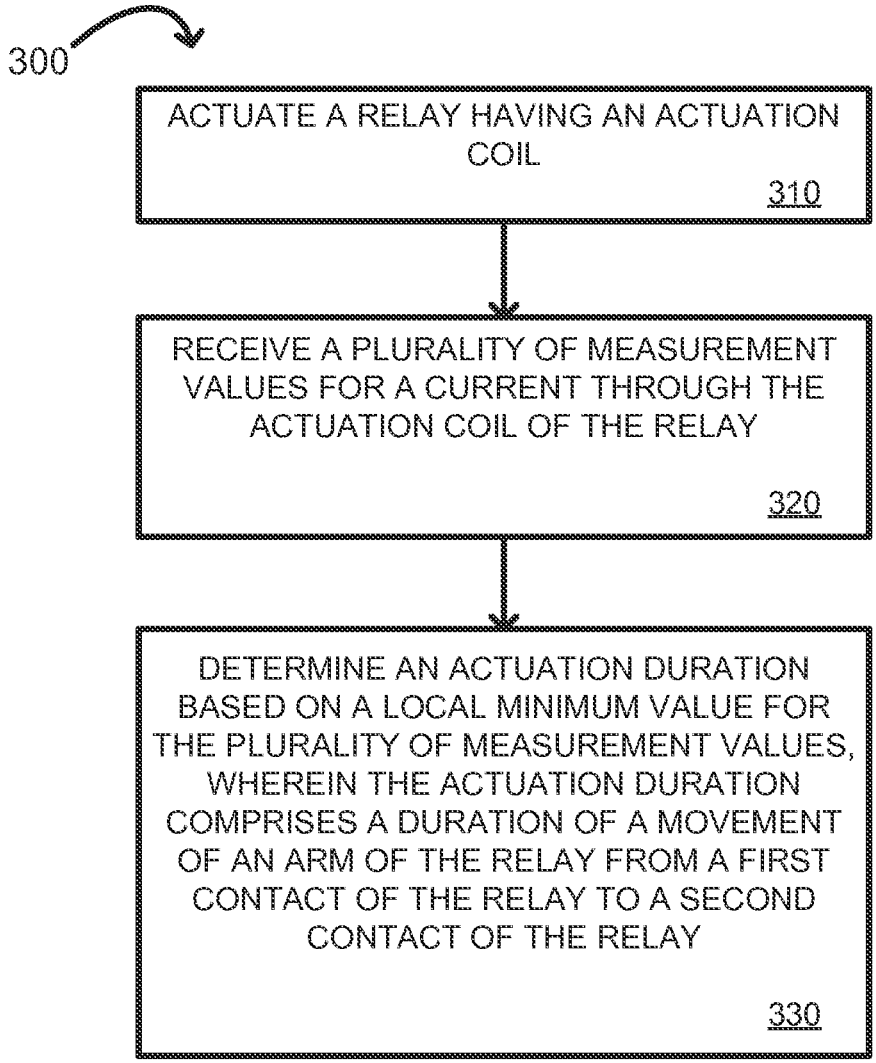
FIG. 4 is a flow chart illustrating an example method of determining the actuation duration of a relay.

FIG. 4 is a flow chart illustrating an example method 300 of determining the actuation duration of the relay 102. For illustrative purposes, the method 300 is described with reference to the system implementations depicted in FIGS. 1-3. Other implementations, however, are possible.

The method 300 involves the controller 112 actuating the relay 102 at block 310. The controller 112 can use a default time value stored in the memory 122 to actuate the relay 102. Some aspects can include the controller 112 being configured to actuate the relay by configuring the voltage source to provide a voltage pulse to the actuation coil. Other aspects can include the controller 112 being configured to actuate the relay by configuring the current source to provide a current pulse to the actuation coil.

The method 300 further involves the controller 112 receiving a plurality of measurement values for the current $i_{coil}$ through the actuation coil 116 at block 320. The controller 112 can monitor the current $i_{coil}$ through the actuation coil 116 for a predetermined amount of time. The current sensing device 110 can measure the electrical current $i_{coil}$ passing through the actuation coil 116. The controller 112 can be communicatively coupled to the current sensing device 110 such that the controller 112 can receive measurement values for the electrical current $i_{coil}$. The controller 112 can filter the current measurement data to exclude noise.

The method 300 further involves the controller 112 determining the actuation duration based on the local minimum current value 214 of the current measurement values at block 330. The controller 112 can analyze the current measurement data to identify a local maximum current value 210 and a local minimum current value 214. The controller 112 can determine an actuation duration $t_{duration}$ by identifying the difference between time value 216 corresponding to the local minimum current value 214 and the time value 208 at which the relay 102 is actuated. The controller 112 can store the actuation duration $t_{duration}$ to the memory 122.

Figure 5:
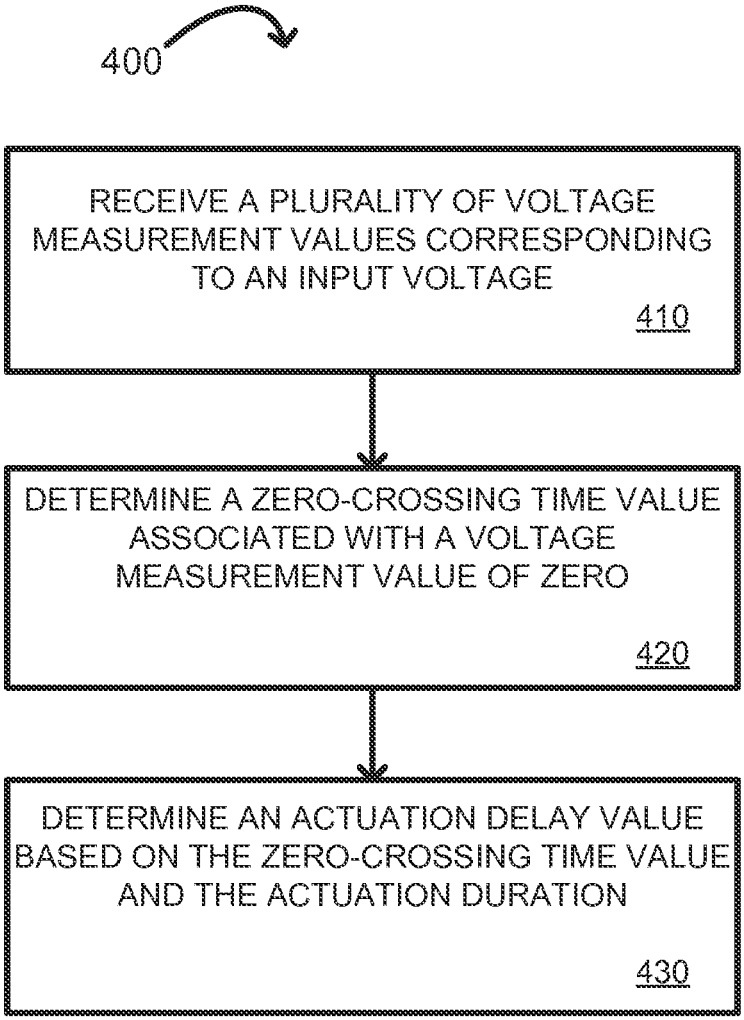
FIG. 5 is a flow chart illustrating an example method of determining the actuation delay for a relay.

Additional or alternative aspects can include the controller 112 calculating an actuation delay. FIG. 5 is a flow chart illustrating an example method 400 of determining the actuation delay for the relay 102. For illustrative purposes, the method 400 is described with reference to the system implementation depicted in FIG. 1. Other implementations, however, are possible.

The method 400 involves the controller 112 receiving a plurality of voltage measurement values corresponding to the input voltage at block 410. The controller 112 can receive the voltage measurement values for an input voltage at an input of the relay from a voltage sampling device. The controller 112 can determine a frequency of the input voltage from the plurality of voltage measurement values.

The method 400 further involves the controller 112 determining a zero-crossing time value associated with one or more voltage measurement values at block 420. For example, the controller 112 can determine that the input voltage has a frequency of 50 Hz or 60 Hz. For a frequency of 50 Hz, a zero-crossing time value $t_{zero}$ can be 10 milliseconds. For a frequency of 60 Hz, a zero-crossing time value $t_{zero}$ can be 8.33 milliseconds. The controller 112 can store the zero-crossing time value $t_{zero}$ to the memory 122.

The method 400 further involves the controller 112 determining an actuation delay value based on the zero-crossing time value and the actuation duration at block 430. The controller 112 can calculate an actuation delay value based on the zero-crossing time value and the actuation duration. The actuation delay $t_{delay}$ can be the difference between the actuation duration and the zero-crossing time value, as represented by the equation $t_{delay}=t_{zero}-t_{actuation}$. The controller 112 can store the actuation delay $t_{delay}$ to the memory 122. The controller 112 can actuate the relay 102 at a time value that is offset from a zero-crossing time value by the actuation delay $t_{delay}$.

Additional or alternative aspects can include determining a relationship between the actuation duration of the relay 102 and ambient temperature. The contact closure time is also dependant on the ambient temperature. This temperature can directly affect a pick-up voltage for the relay 102 and the resistance of the actuation coil 116. The resistance of the actuation coil 116 can be calculated based on a measurement of the ambient temperature and a known relationship between the resistance of the actuation coil 116 and temperature. However, due to differences in types of relay 102 and their respective components, calculating the resistance of the actuation coil 116 in this manner does not provide a widely-applicable solution for adjusting an actuation delay of a relay 102.

Figure 6:
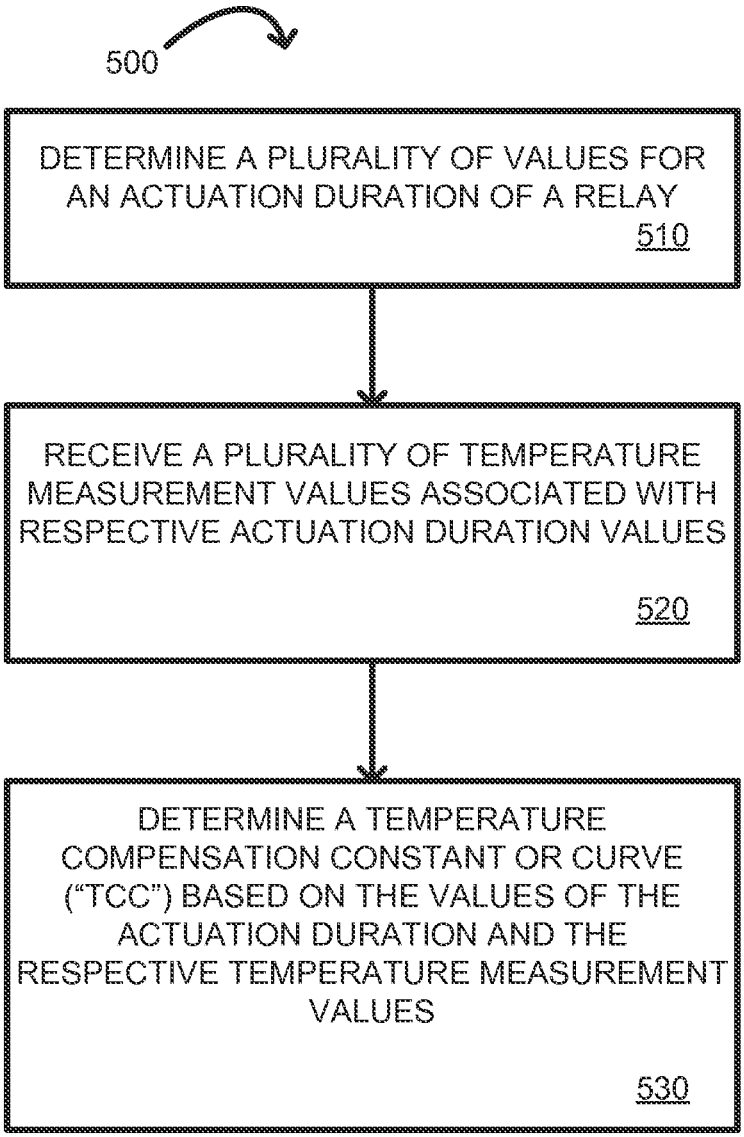
FIG. 6 is a flow chart illustrating an example method of adjusting the actuation delay for the relay based on an ambient temperature.

FIG. 6 is a flow chart illustrating an example method 500 of adjusting the actuation delay for the relay 102 based on ambient temperature. For illustrative purposes, the method 500 is described with reference to the system implementation depicted in FIG. 1. Other implementations, however, are possible.

The method 500 involves the controller 112 determining a plurality of values for the actuation duration of the relay 102 at block 510. The plurality of values for the actuation duration of the relay 102 can be determined via the method 300, described above.

The method 500 further involves the controller 112 receiving a plurality of temperature measurement values for the ambient temperature associated with the respective actuation duration values at block 520. The controller 112 can be configured to monitor measurements of the ambient temperature. The measurements of the ambient temperature can be performed by the temperature measurement device 124.

The method 500 further involves the controller 112 determining a temperature compensation constant or curve ("TCC") based on a relationship between the plurality of actuation durations and the plurality of temperature measurement values at block 530. The temperature gradient and the number of recorded values for the method 500 can be adjusted based on a required tolerance for a system or device including a relay and the processing power and memory capacity of controller 112. The controller 112 may be programmed with a default TCC that can be modified as the controller determines the relationship between temperature dependency of a specific relay 102 and the dynamic changes as the relay 102 ages.

The compensation process can allow for accurately estimating the actuation duration for different types of relays.

Example Circuits for Measuring a Current Through the Actuation Coil

FIGS. 7-13 schematically depict examples of switching devices 109*a-g*. Although FIGS. 7-13 depict the current sensing switching devices 109*a-g* coupled to a single pole, double throw ("SPDT") electrically held relay, the switching devices 109*a-g* can be implemented with any relay. Examples of such relays can include (but are not limited to) single pole, single throw relays, double pole, double throw relays, single coil latching relays, dual coil latching relays, etc.

Figure 7:
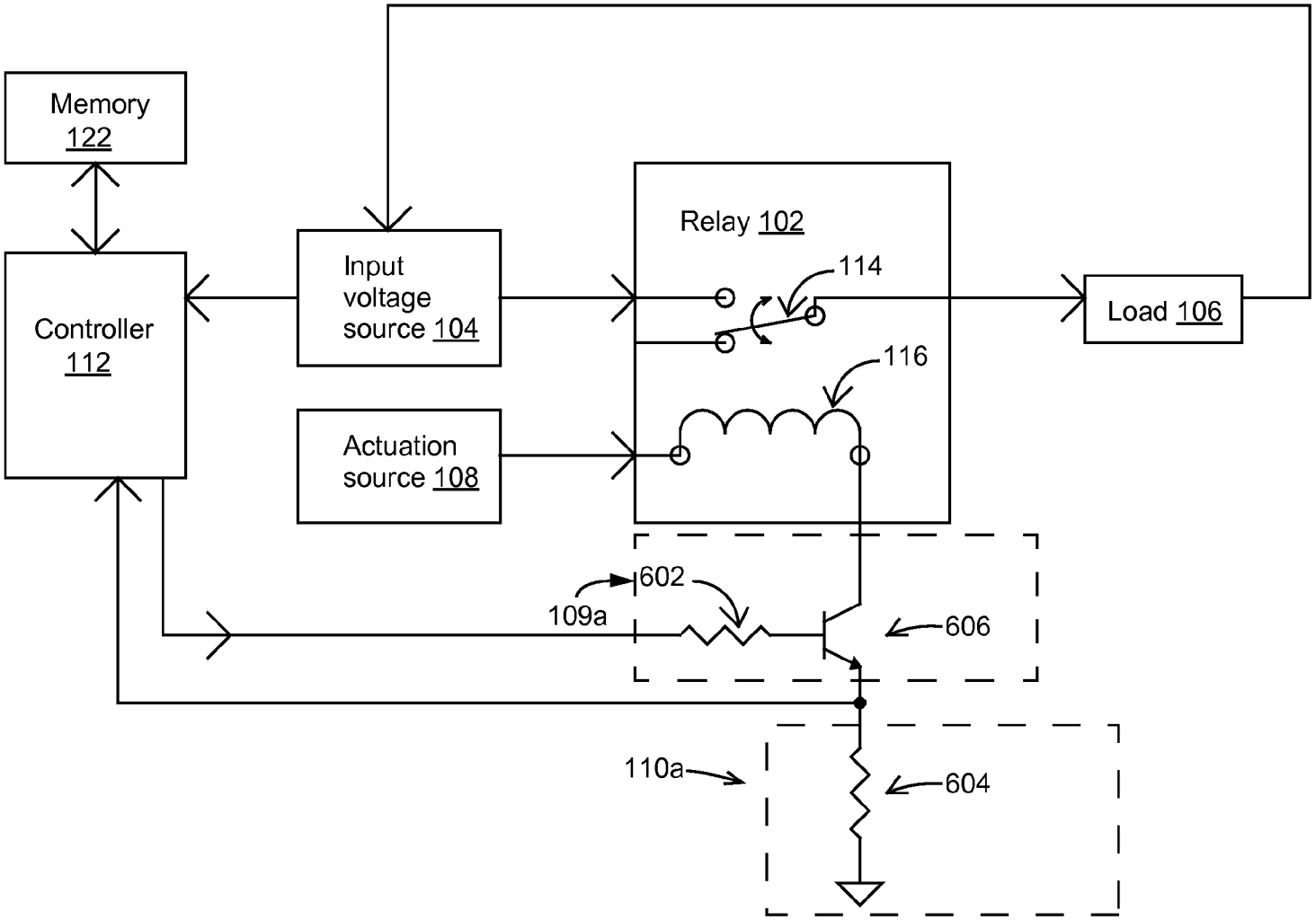
FIG. 7 is a partial schematic diagram illustrating an example system for determining the actuation duration of a single pole, double throw ("SPDT") electrically held relay.

FIG. 7 is a partial schematic diagram illustrating an example system for determining the actuation duration of a relay 102 that is an SPDT electrically held relay. The switching devices 109*a* includes a biasing resistor 602 and a transistor 606. The current sensing device 110*a* includes a current sense resistor 604.

The transistor 606 can be used as a coil actuation switch. The collector of the transistor 606 can be coupled to the actuation coil 116. The controller 112 can provide a biasing current to the base of the transistor 606 via the biasing resistor 602. The electrical current $i_{coil}$ can flow through the current sense resistor 604 coupled to the emitter of the transistor 606. The current sense resistor 604 can be used by the controller 112 to measure the electrical current $i_{coil}$.

Figure 8:
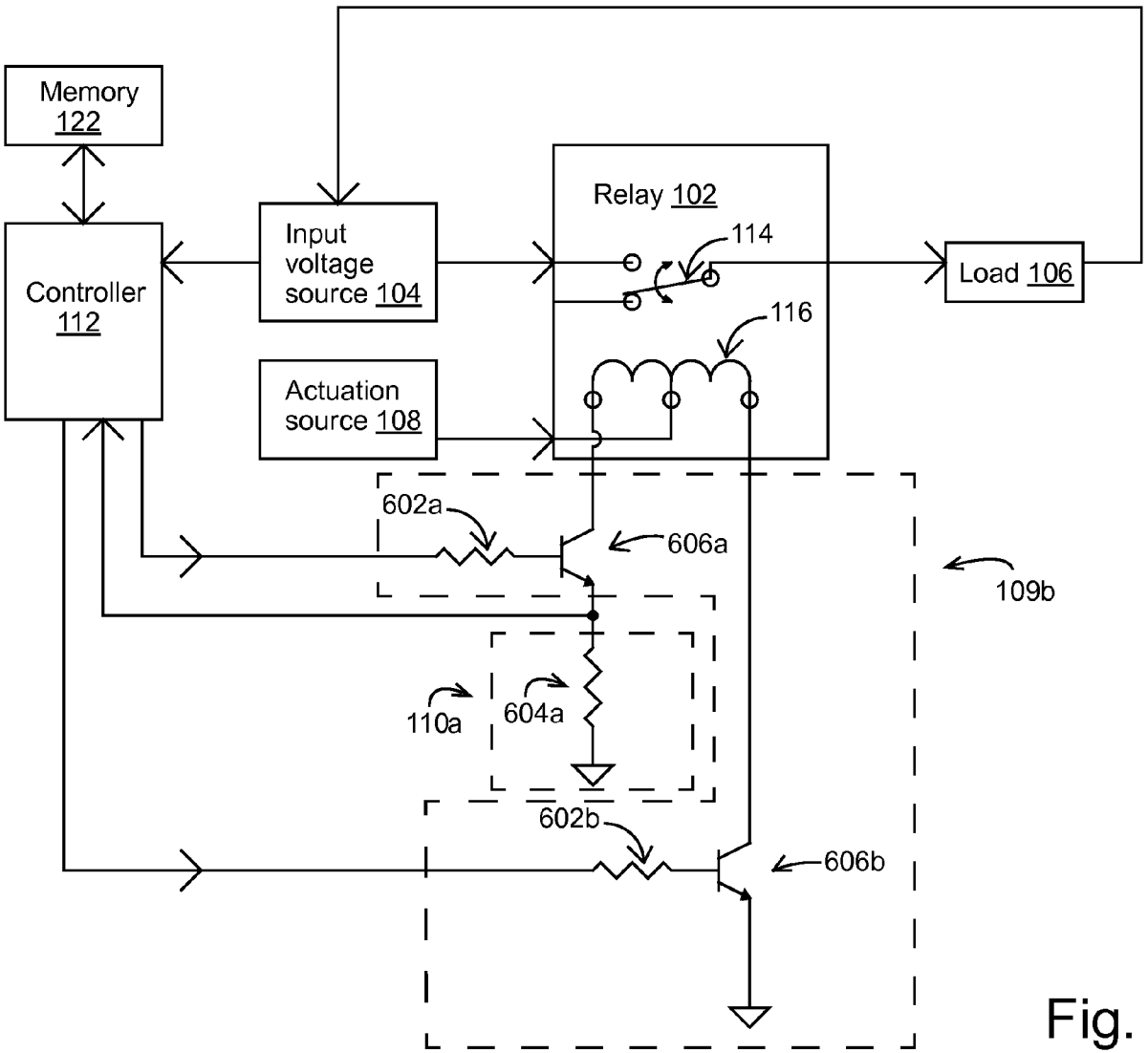
FIG. 8 is a partial schematic diagram illustrating an example system for determining the actuation duration of a dual coil SPDT latching relay having closed contact detection circuitry.

FIG. 8 is a partial schematic diagram illustrating an example system for determining the actuation duration of a relay 102 that is a dual coil SPDT latching relay having closed contact detection circuitry. The switching device 109*b* includes biasing resistor 602*a*, 602*b* and transistors 606*a*, 606*b*. The current sensing device 110*b* includes a current sense resistor 604*a*.

For a relay 102 in a closed position, the controller 112 can respectively provide biasing currents to the bases of the transistors 606*a*, 606*b* via the biasing resistors 602*a*, 602*b*. The electrical current $i_{coil}$ can flow through the current sense resistor 604 coupled to the emitter of the transistor 606*a*. The current sense resistor 604 can be used by the controller 112 to measure the electrical current $i_{coil}$ through the actuation coil 116.

Figure 9:
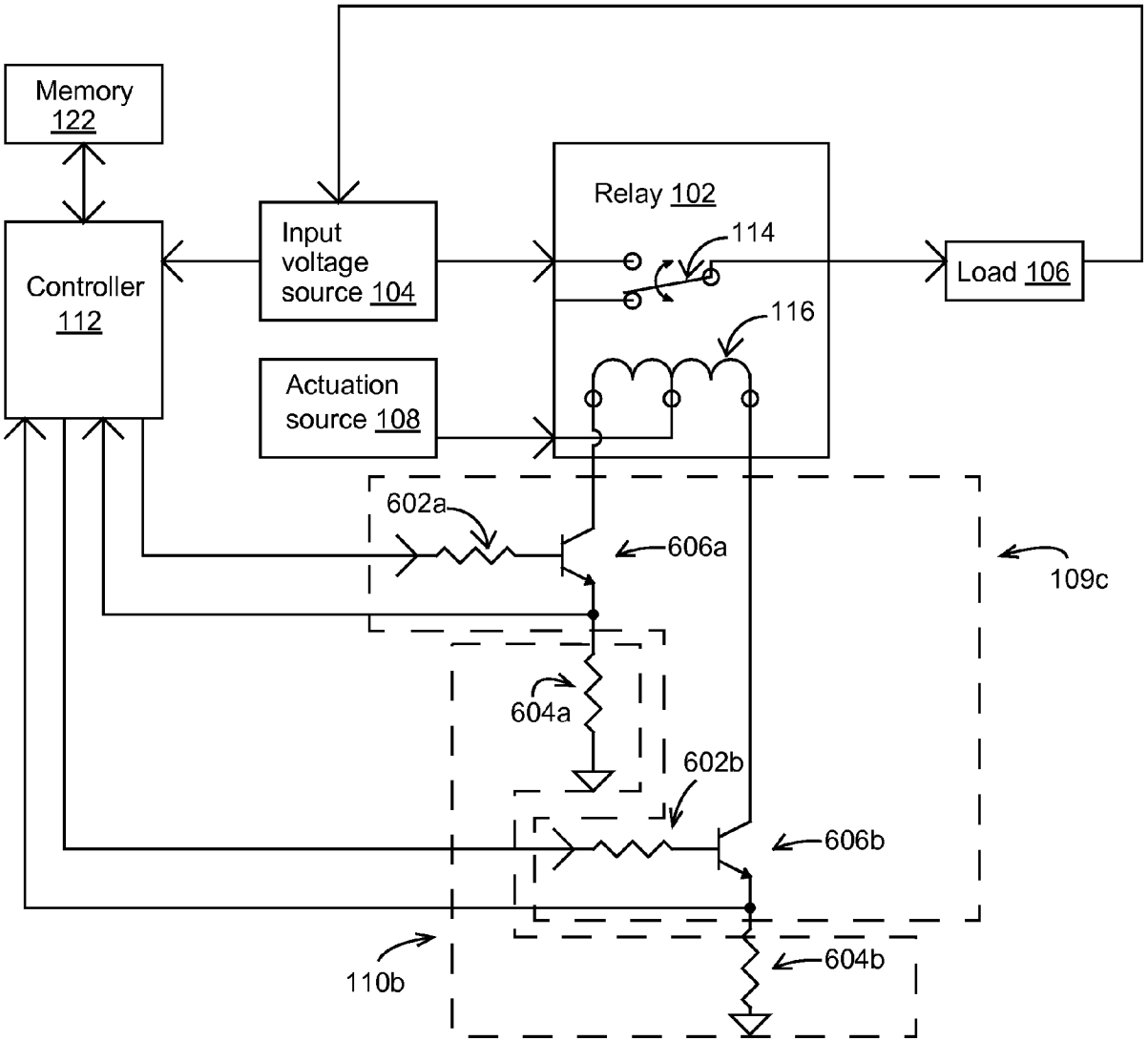
FIG. 9 is a partial schematic diagram illustrating an example system for determining the actuation duration of a dual coil SPDT latching relay having closed contact detection circuitry and open contact detection circuitry.

FIG. 9 is a partial schematic diagram illustrating an example system for determining the actuation duration of a relay 102 that is a dual coil SPDT latching relay having closed contact detection circuitry and open contact detection circuitry. The switching device 109*c* includes biasing resistor 602*a*, 602*b* and transistors 606*a*, 606*b*. The current sensing device 110*c* includes current sense resistors 604*a*, 604*b*.

The controller 112 can respectively provide biasing currents to the bases of the transistors 606*a*, 606*b* via the biasing resistors 602*a*, 602*b*. For a relay 102 that is in a closed position, the electrical current $i_{coil}$ can flow through the current sense resistor 604*a* coupled to the emitter of the transistor 606*a*. The current sense resistor 604*a* can be used by the controller 112 to measure the electrical current $i_{coil}$ through the actuation coil 116. For the relay 102 that is in an open position, the electrical current $i_{coil}$ can flow through the current sense resistor 604*b* coupled to the emitter of the transistor 606*b*. The current sense resistor 604*b* can be used by the controller 112 to measure the electrical current $i_{coil}$ through the actuation coil 116.

Figure 10:
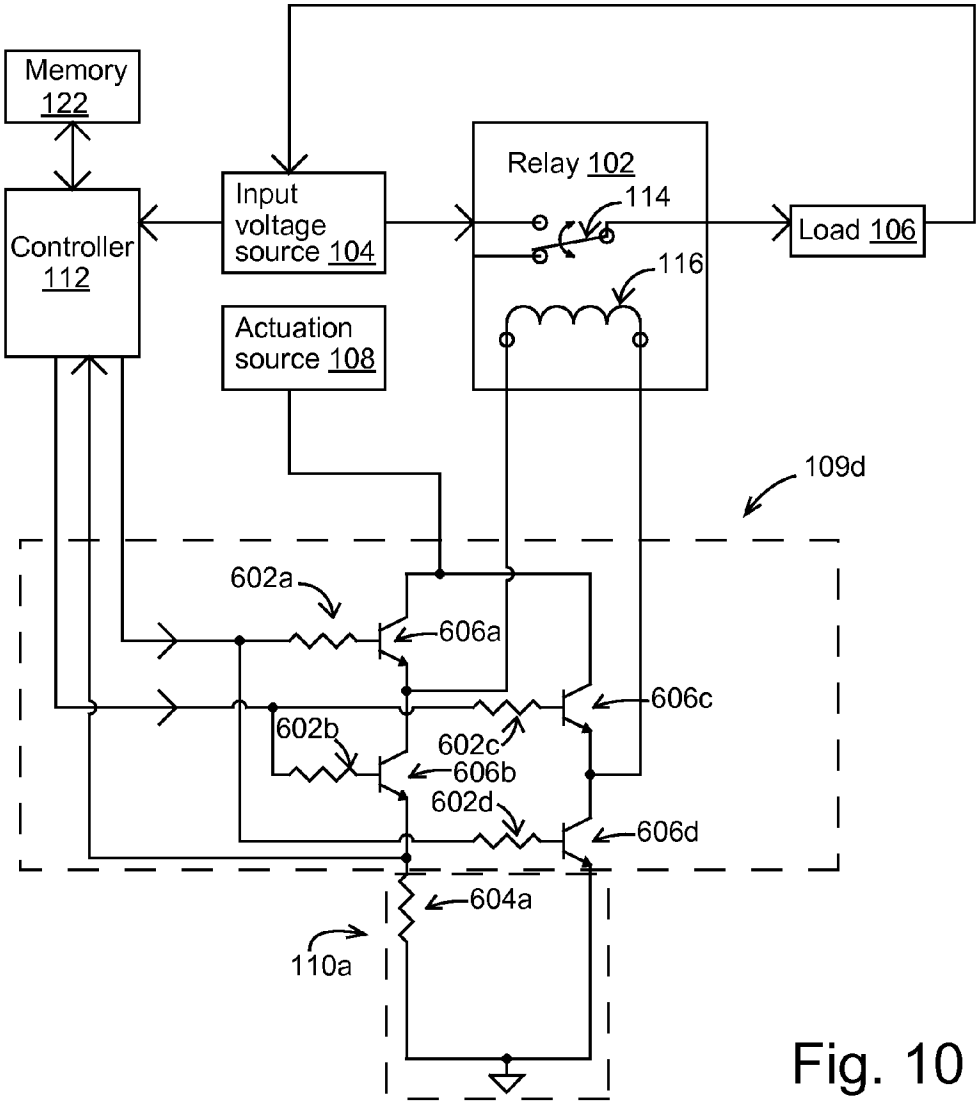
FIG. 10 is a partial schematic diagram illustrating an example system for determining the actuation duration of a single coil SPDT latching relay having closed contact detection circuitry.

FIG. 10 is a partial schematic diagram illustrating another example system for determining the actuation duration of a relay 102 that is a single coil SPDT latching relay having closed contact detection circuitry. The switching device 109*d* includes biasing resistors 602*a-d* and transistors 606*a-d*. The current sensing device 110*d* includes a current sense resistor 604*a*.

The transistors 606*a-d* can provide an H-bridge for actuating the relay 102. The controller 112 can respectively provide biasing currents to the bases of the transistors 606*a-d* via the biasing resistors 602*a-d*.

For a relay 102 that is in a closed position, the biasing current provided to the base of the transistors 606*b*, 606*c* can allow current to flow from the actuation source 108 through the transistor 606*c* to the actuation coil 116 and the current sense resistor 604*a*. The biasing current provided to the base of the transistor 606*a*, 606*d* can allow electrical current $i_{coil}$ to flow in the opposite direction through the actuation coil 116. The current sense resistor 604*a* can be used by the controller 112 to measure the electrical current $i_{coil}$ through the actuation coil 116. Transistors 606*a*, 606*d* can conduct current through the coil 116 in one direction, thus forcing the relay 102 into an ON state. The transistors 606*b*, 606*c* of the H-bridge are conducting the current through the coil 116 in an opposite direction. The opposite polarity can force the relay 102 into an OFF state.

Figure 11:
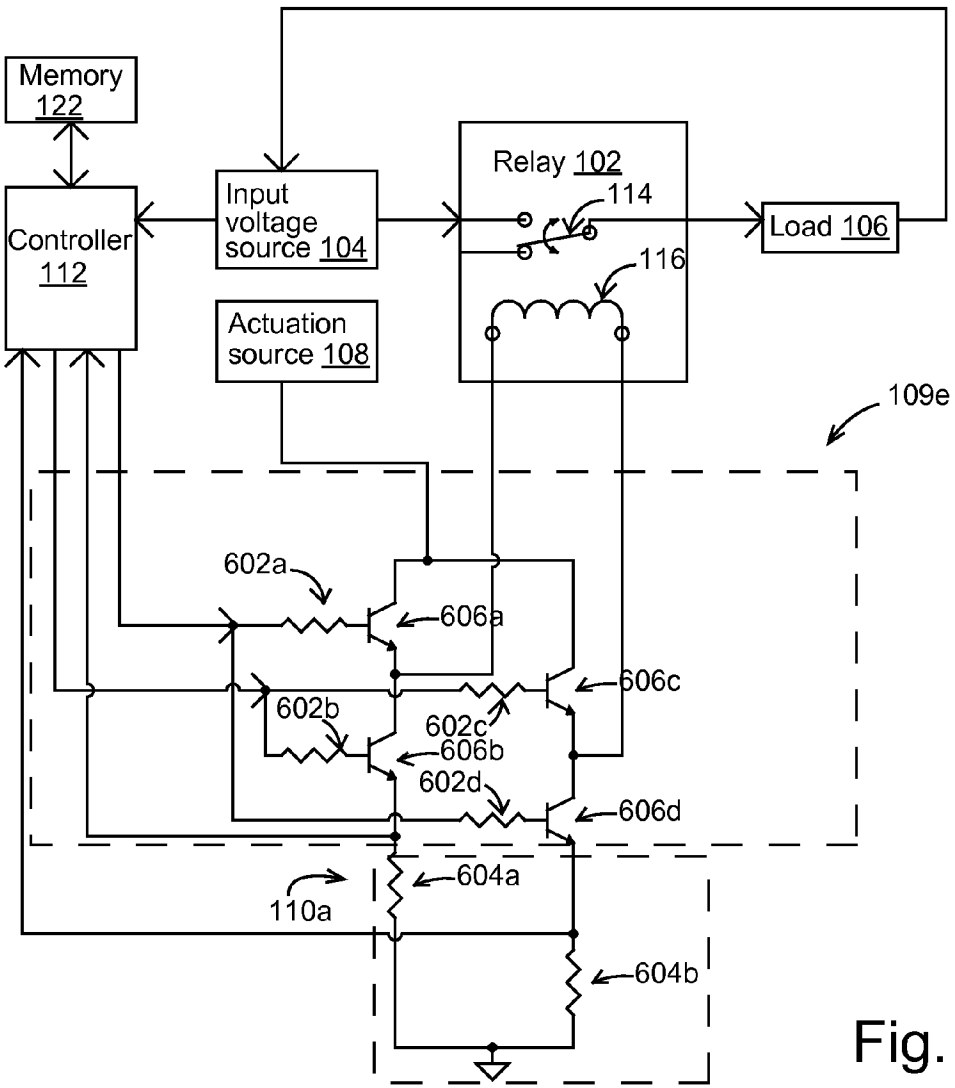
FIG. 11 is a partial schematic diagram illustrating an example system for determining the actuation duration of a single coil SPDT latching relay having closed contact detection circuitry and open contact detection circuitry.

FIG. 11 is a partial schematic diagram illustrating an example system for determining the actuation duration of a relay 102 that is a single coil SPDT latching relay having closed contact detection circuitry and open contact detection circuitry. The switching device 109*e* includes biasing resistors 602*a-d* and transistors 606*a-d*. The current sensing device 110*e* includes the current sense resistors 604*a*, 604*b*.

The controller 112 can respectively provide biasing currents to the bases of the transistors 606*a-d* via the biasing resistors 602*a-d*.

For a relay 102 that is in a closed position, the biasing current provided to the base of the transistors 606*b*, 606*c* can allow current to flow from the actuation source 108 through the transistors 606*b*, 606*c* to the actuation coil 116 and current sense resistor 604*a*. The current sense resistor 604*a* can be used by the controller 112 to measure the electrical current $i_{coil}$ through the actuation coil 116. The biasing current provided to the base of the transistor 606*a* and 606*d* enables the reverse relay coil current flow, thereby setting the relay 102 to an open position. The current sense resistor 604*b* can be used by the controller 112 to measure the electrical current $i_{coil}$ through the actuation coil 116 to confirm the open position of the relay 102.

Figure 12:
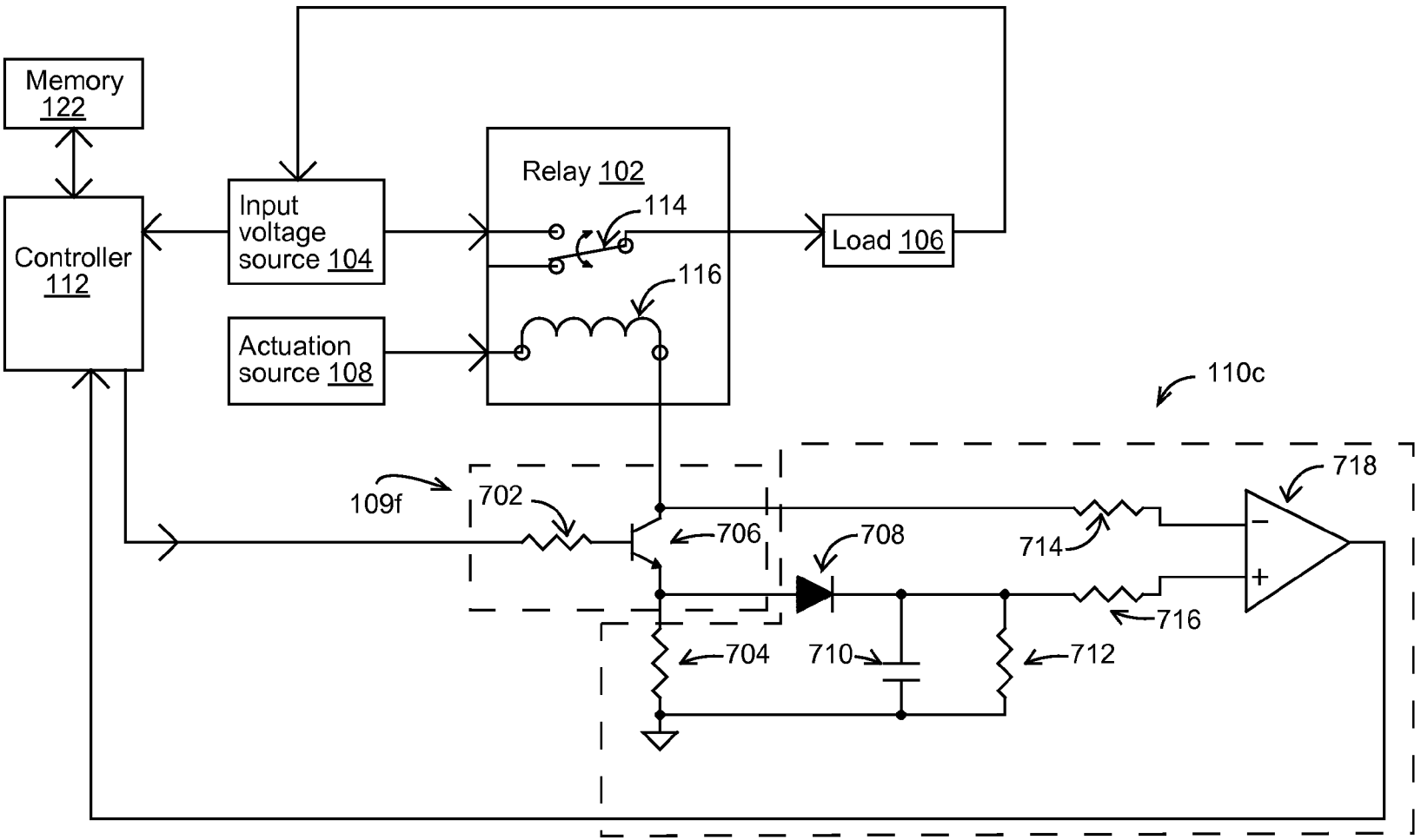
FIG. 12 is a partial schematic diagram illustrating an example system for determining the actuation duration of a SPDT electrically held relay having discrete sensing circuitry.

FIG. 12 is a partial schematic diagram illustrating an example system for determining the actuation duration of a relay 102 that is a SPDT single coil electrically held relay having discrete sensing circuitry. The switching device 109*c* can include a transistor 706 that is biased by a current provided by the controller 112 via the biasing resistor 702. The current sensing device can be a comparator circuit that includes the current sense resistor 704, a blocking diode 708, a filter capacitor 710, a filter resistor 712, current limit resistors 714, 716, and a comparator 720.

The collector of the transistor 706 can be coupled to the actuation coil 116 and coupled to an input of a comparator 718 via a current limit resistor 714. The emitter of the transistor 706 can be coupled to the current sense resistor 704 and coupled to the anode of a blocking diode 708. The cathode of the blocking diode 708 can be coupled to a filter capacitor 710 and a filter resistor 712. The cathode of the blocking diode 708 can also be coupled to an input of the comparator 718 via a current limit resistor 716. The output of the comparator 718 can be a measurement of the current $i_{coil}$ that can be provided to the controller 112.

Figure 13:
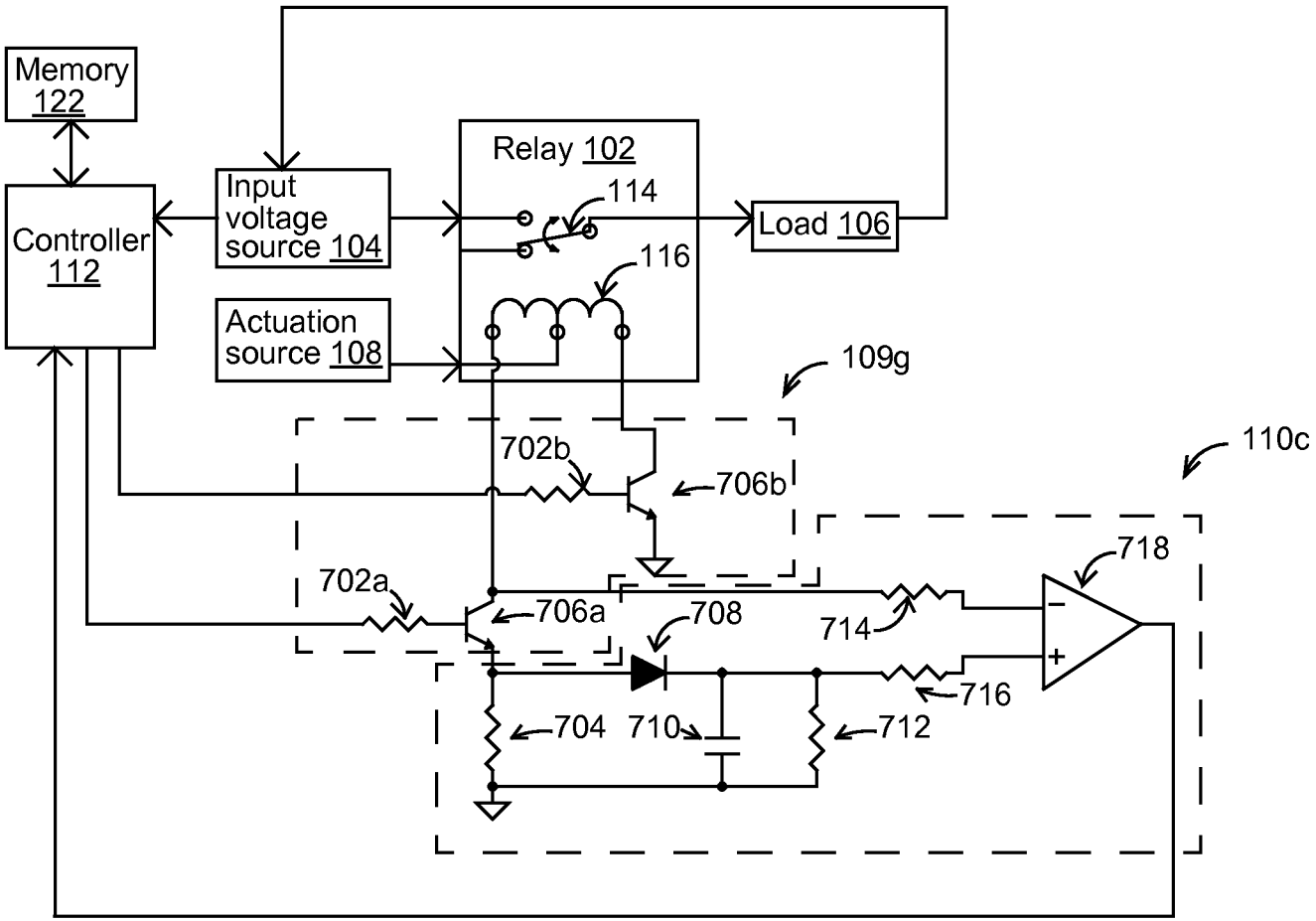
FIG. 13 is a partial schematic diagram illustrating an example system for determining the actuation duration of a SPDT electrically held relay having discrete sensing circuitry for closed contact detection.

FIG. 13 is a partial schematic diagram illustrating an example system for determining the actuation duration of a relay 102 that is a dual-coil SPDT electrically held relay having discrete sensing circuitry for closed contact detection.

The switching device 109*d* can include a transistor 706*a* that is biased by a current provided by the controller 112 via the biasing resistor 702*a* and a transistor 706*b* that is biased by a current provided by the controller 112 via the biasing resistor 702*b*. The current sensing device can be a comparator circuit that includes the current sense resistor 704, a blocking diode 708, a filter capacitor 710, a filter resistor 712, current limit resistors 714, 716, and a comparator 720.

The transistor 706*a*. The collector of the transistor 706*b* can be coupled to the actuation coil 116. Biasing the transistor 706*b* can allow the electrical current $i_{coil}$ to flow through the actual coil 116, thereby actuating the relay 102. The electrical current $i_{coil}$ can be measured using the comparator 718 as depicted in FIG. 11.

The foregoing is provided for purposes of illustrating, describing, and explaining aspects of the present invention and is not intended to be exhaustive or to limit the invention to the precise forms disclosed. Further modifications and adaptation to these embodiments will be apparent to those skilled in the art and may be made without departing from the scope and spirit of the invention.

What is claimed is:

1. A system comprising:

a relay having an actuation coil;

a current-sensing device configured to measure a current through the actuation coil, the current-sensing device comprising a current sense resistor in series with the actuation coil and ground; and a controller, wherein the controller is configured to perform operations comprising:

actuating the relay, receiving from the current-sensing device a plurality of measurement values for the current through the actuation coil; and determining an actuation duration based on a local minimum value for the plurality of measurement values, wherein the actuation duration corresponds to a duration of a movement of an armature of the relay from a first contact of the relay to a second contact of the relay;

wherein the current-sensing device further comprises a comparator circuit and a transistor, wherein the transistor is connected in series with the actuation coil and the current sense resistor;

wherein the comparator circuit comprises a comparator and the current sense resistor, wherein the current sense resistor is connected by way of a diode to a capacitor and a resistor of the comparator circuit, wherein the capacitor and the resistor are connected in parallel, wherein the diode is included in an electrical path from a point between the transistor and the current sense resistor to an input of the comparator, wherein the input of the comparator is also connected to the capacitor and the resistor, wherein the controller receives the plurality of measurement values from the output of the comparator;

wherein the controller is configured to actuate the relay by providing a biasing current to the transistor that is sufficient to allow current to flow from the actuation coil through the transistor and the current sense resistor to the ground.

2. The system of claim 1, further comprising an actuation voltage source coupled to the actuation coil of the relay and a switching device, wherein the controller is configured to actuate the relay by configuring the switching device to allow a voltage pulse to be provided by the actuation voltage source to the actuation coil.

3. The system of claim 1, further comprising an actuation current source coupled to the actuation coil of the relay and a switching device, wherein the controller is configured to actuate the relay by configuring the switching device to allow a current pulse to be provided by the actuation current source to the actuation coil.

4. The system of claim 1, wherein the current-sensing device further comprises an analog-to-digital conversion circuit.

5. The system of claim 1, further comprising a voltage detection device configured to measure an input voltage at an input of the relay and wherein the controller is configured to perform additional operations comprising:

receiving from the voltage detection device a plurality of voltage measurement values corresponding to the input voltage;

determining a zero-crossing time value associated with a voltage measurement value of zero; and calculating an actuation delay value based on the zero-crossing time value and the actuation duration.

6. The system of claim 5, wherein the controller is further configured to store the actuation delay value in a non-transitory computer readable medium.

7. The system of claim 1, wherein the controller is further configured to store the value for the actuation duration in a non-transitory computer readable medium.

8. The system of claim 1, further comprising a temperature measurement device configured to measure a temperature of the relay and wherein the controller is configured to perform additional operations comprising:

determining a plurality of actuation durations;

receiving a plurality of temperature measurement values for the temperature, wherein each temperature measurement value is associated with a respective actuation duration; and determining a temperature compensation constant based on a relationship between the plurality of actuation durations and the plurality of temperature measurement values.

9. A method comprising:

actuating, by a controller, a relay having an actuation coil;

receiving, by the controller, a plurality of measurement values for a current through the actuation coil, wherein the plurality of measurement values are received from a current-sensing device configured to measure the current through the actuation coil and comprising a current sense resistor in series with the actuation coil and ground; and determining, by the controller, an actuation duration based on a local minimum value for the plurality of measurement values, wherein the actuation duration corresponds to a duration of a movement of an armature of the relay from a first contact of the relay to a second contact of the relay;

wherein the current-sensing device further comprises a comparator circuit and a transistor, wherein the transistor is connected in series with the actuation coil and the current sense resistor;

wherein the comparator circuit comprises a comparator and the current sense resistor, wherein the current sense resistor is connected by way of a diode to a capacitor and a resistor of the comparator circuit, wherein the capacitor and the resistor are connected in parallel, wherein the diode is included in an electrical path from a point between the transistor and the current sense resistor to an input of the comparator, wherein the input of the comparator is also connected to the capacitor and the resistor, wherein the controller receives the plurality of measurement values from the output of the comparator;

wherein actuating the relay comprises providing a biasing current to the transistor that is sufficient to allow current to flow from the actuation coil through the transistor and the current sense resistor to the ground.

10. The method of claim 9, wherein actuating the relay comprises configuring a switching device to allow a voltage source coupled to the actuation coil of the relay to provide a voltage pulse to the actuation coil.

11. The method of claim 9, wherein actuating the relay comprises configuring a switching device to allow a current source coupled to the actuation coil of the relay to provide a current pulse to the actuation coil.

12. The method of claim 9, further comprising:

receiving, by the controller, a plurality of voltage measurement values corresponding to an input voltage at an input of the relay;

determining, by the controller, a zero-crossing time value associated with a voltage measurement value of zero; and calculating, by the controller, an actuation delay value based on the zero-crossing time value and the actuation duration.

13. The method of claim 12, further comprising storing the actuation delay value in a non-transitory computer readable medium.

14. The method of claim 9, further comprising:

determining, by the controller, a plurality of actuation durations;

receiving, by the controller, a plurality of temperature measurement values for a temperature of the relay, wherein each temperature measurement value is associated with a respective actuation duration; and determining, by the controller, a temperature compensation constant based on a relationship between the plurality of actuation durations and the plurality of temperature measurement values.

15. The system of claim 1, wherein a terminal of the current-sensing resistor is shorted to ground.

* * * * *